US011925265B2

(12) United States Patent
Xiang et al.

(10) Patent No.: US 11,925,265 B2
(45) Date of Patent: Mar. 12, 2024

(54) TRANSMISSION ROD ASSEMBLY AND A HEIGHT-ADJUSTABLE DESK THEREOF

(71) Applicant: LOCTEK ERGONOMIC TECHNOLOGY CORP., Ningbo (CN)

(72) Inventors: Lehong Xiang, Ningbo (CN); Tao Lin, Ningbo (CN); Fangyuan Li, Ningbo (CN); Jia Ge, Ningbo (CN); Lijun Zhao, Ningbo (CN)

(73) Assignee: LOCTEK ERGONOMIC TECHNOLOGY CORP., Ningbo (CN)

( * ) Notice: Subject to any disclaimer, the term of this patent is extended or adjusted under 35 U.S.C. 154(b) by 0 days.

(21) Appl. No.: 17/818,079

(22) Filed: Aug. 8, 2022

(65) Prior Publication Data

US 2023/0309688 A1 Oct. 5, 2023

(30) Foreign Application Priority Data

Mar. 30, 2022 (CN) ..... 202210327303.9
Mar. 30, 2022 (CN) ..... 202210327331.0

(51) Int. Cl.
*A47B 9/20* (2006.01)
*A47B 21/02* (2006.01)

(52) U.S. Cl.
CPC ..... *A47B 9/20* (2013.01); *A47B 21/02* (2013.01); *A47B 2200/0052* (2013.01)

(58) Field of Classification Search
CPC ... A47B 21/02; A47B 2200/0052; A47B 9/04; A47B 9/20; A47B 9/08
USPC ..... 108/147; 248/188.2, 188.4, 188.5
See application file for complete search history.

(56) References Cited

U.S. PATENT DOCUMENTS 4,615,279 A * 10/1986 de la Haye ..... A47B 9/04 108/65
4,627,364 A * 12/1986 Klein ..... A47B 17/02 108/147
8,490,555 B1 * 7/2013 Agee ..... A47B 9/04 108/147
10,524,564 B1 * 1/2020 Wu ..... A47B 9/20
10,531,732 B1 * 1/2020 Huang ..... F16B 7/14
11,419,410 B1 * 8/2022 Tang ..... A47B 9/12
(Continued)

FOREIGN PATENT DOCUMENTS

DE 19815444 C1 * 6/1999 ..... A47B 9/02

*Primary Examiner* — Jose V Chen
(74) *Attorney, Agent, or Firm* — Pearne & Gordon LLP

(57) ABSTRACT

A transmission rod assembly for a height-adjustable desk comprises: a first transmission head having positioning grooves; a second transmission head having positioning blocks; an elastic piece axially limiting abutment of the first and second transmission heads, the positioning blocks positioning respective positioning grooves; a sleeve pipe having an end mounted to the second transmission head, the elastic piece being mounted in the sleeve pipe, and an end of the elastic piece abutting the second transmission head; a first transmission rod having an end protruding into the other end of the sleeve pipe and abutting the other end of the elastic piece, the sleeve pipe limiting the first transmission rod; and a locking assembly mounted on the other end of the sleeve pipe, the locking assembly limiting the sleeve pipe and clamping the first transmission rod. Thus, mounting can be completed by elastic squeeze, bringing simple structure and easy operation.

17 Claims, 15 Drawing Sheets

(56) References Cited

U.S. PATENT DOCUMENTS

| | | | | |
|---|---|---|---|---|
| 2002/0108544 | A1* | 8/2002 | Hsu | A47B 9/04 108/147.19 |
| 2011/0061574 | A1* | 3/2011 | Klinke | F16H 1/225 108/147.19 |
| 2016/0345722 | A1* | 12/2016 | Chen | A47B 9/04 |
| 2017/0303679 | A1* | 10/2017 | Tseng | A47B 9/04 |
| 2018/0064241 | A1* | 3/2018 | Tseng | A47B 9/10 |
| 2021/0015250 | A1* | 1/2021 | Chu | A47B 17/02 |
| 2021/0100355 | A1* | 4/2021 | Jørgensen | A47B 3/0809 |
| 2021/0259403 | A1* | 8/2021 | Swetharanyam | A47B 9/20 |
| 2023/0000244 | A1* | 1/2023 | Lin | A47B 9/04 |
| 2023/0029425 | A1* | 1/2023 | Lin | A47B 9/20 |

* cited by examiner

TRANSMISSION ROD ASSEMBLY AND A HEIGHT-ADJUSTABLE DESK THEREOF

TECHNICAL FIELD

The present invention relates to the technical field of height-adjustable desks, and in particular to a transmission rod assembly and a height-adjustable desk thereof.

BACKGROUND

In the prior art, in a transmission rod mechanism used by a height-adjustable desk, various components such as connectors and transmission rods are fixedly connected through screw structures. The fixed connection requires use of tools such as wrenches. Therefore, there are problems of unscrewing prior to mounting and screwing down several times subsequent to stretching and mounting, leading to troublesome operations and difficult mounting and long-time consumption for mounting. Further, the screws may be loosened after a long time of use, resulting in failure of the transmission mechanism.

SUMMARY

In order to solve the problems existing in the existing transmission rod, the present invention provides a transmission rod assembly and a height-adjustable desk thereof, where mounting can be completed by elastic squeeze, bringing simple structure and easy operation.

The specific technical solution is described below.

Provided is a transmission rod assembly, comprising:

a first transmission head, where a plurality of positioning grooves are disposed along a circumferential direction of the first transmission head;

a second transmission head, where a plurality of positioning blocks disposed along a circumferential direction of the second transmission head;

an elastic piece, abutted against the first transmission head or the second transmission head, where the second transmission head and the first transmission head are abutted against each other in an axial limiting manner by use of a restoring force of the elastic piece, and the plurality of positioning blocks are cooperated with the plurality of positioning grooves in a positioning manner respectively;

a sleeve pipe, where the sleeve pipe is a hollow structure with both ends open; the second transmission head is mounted at an end of the sleeve pipe, the elastic piece is mounted in the sleeve pipe, and an end of the elastic piece is abutted against the second transmission head;

a first transmission rod, where an end of the first transmission rod protrudes into the other end of the sleeve pipe and is abutted against the other end of the elastic piece, the sleeve pipe is cooperated with the first transmission rod in a limiting manner along a circumferential direction of the sleeve pipe, and the sleeve pipe is cooperated with the first transmission rod in a limiting manner along an axial direction of the sleeve pipe;

a locking assembly, where the locking assembly is mounted on the other end of the sleeve pipe, the locking assembly is cooperated with the sleeve pipe in a limiting manner along the axial direction of the sleeve pipe, and the locking assembly clamps the first transmission rod.

In the above transmission rod assembly, the positioning groove has at least one first oblique surface, the positioning block has at least one second oblique surface, and the first oblique surface and the second oblique surface are abutted against each other.

Both sides of the positioning groove have the first oblique surface, and both sides of the positioning block have the second oblique surface. When the second transmission head is abutted against the first transmission head in an axial limiting manner, a plurality of positioning blocks cooperate with a plurality of positioning grooves in a positioning manner respectively and the first oblique surfaces are abutted against the second oblique surfaces.

In the above transmission rod assembly, the first transmission head has a protruding column, and a plurality of positioning grooves are located around the protruding column; the second transmission head has a recess, and a plurality of positioning blocks are located around the recess. When the second transmission head is abutted against the first transmission head in an axial limiting manner, the protruding column cooperates with the recess in a positioning manner.

The above transmission rod assembly further comprises a second transmission rod, where the second transmission rod is in transmission connection with the first transmission head.

The first transmission rod and the second transmission rod both are hexagonal transmission rods and the first transmission head has a hexagonal insertion groove.

In the above transmission rod assembly, the locking assembly comprises a locking cover and a jacket. The locking cover is fixedly connected with the sleeve pipe, and the jacket is sleeved on the first transmission rod. The locking cover is operably abutted against an outer wall of the jacket. At least part of the jacket deforms to reduce an inner diameter of at least part of the jacket so as to clamp the first transmission rod.

A hexagonal penetration groove is disposed inside the jacket, the second transmission rod is cooperated with the hexagonal insertion groove in an insertion manner, the first transmission rod penetrates through the hexagonal penetration groove, and the jacket is fixedly cooperated with the first transmission rod by use of squeeze and shrinkage of the locking cover.

A guide ring is disposed at an end of the jacket, and a plurality of clearances are disposed on the guide ring. The locking cover squeezes the guide ring to enable the guide ring to shrink and clamp the first transmission rod.

Two locking grooves are disposed on a sidewall of the other end of the sleeve pipe, and two locking columns are disposed on an inner wall of the locking cover. The two locking columns are cooperated with the two locking grooves in a limiting manner respectively.

When the locking cover is sleeved on the other end of the sleeve pipe, the two locking columns protrude into the two locking grooves respectively. By rotating the sleeve pipe or the locking cover, the two locking columns are cooperated with the two locking grooves in a limiting manner along the axial direction of the sleeve pipe respectively.

A protruding ring is disposed along a periphery of the jacket. The other end of the sleeve pipe is sleeved on a part of the jacket, and the end portion of the other end of the sleeve pipe is abutted against the protruding ring.

In above transmission rod assembly, the first transmission head has a first cylindrical support platform, the protruding column is disposed in a middle portion of the first cylindrical support platform, and a plurality of positioning grooves are located on the periphery of the first cylindrical support platform; the second transmission head has a second cylindrical support platform, the recess is disposed in a middle portion of the second cylindrical support platform, and a plurality of positioning blocks are disposed on the periphery of the second cylindrical support platform respectively. The first cylindrical support platform has the same diameter as the second cylindrical support platform.

When the second transmission head is abutted against the first transmission head in an axial limiting manner, a plurality of positioning blocks are inserted into a plurality of positioning grooves respectively, and the protruding column is inserted into the recess. In this case, an end of the protruding column is abutted against the bottom of the recess in a limiting manner, the first oblique surfaces are abutted against the second oblique surfaces in a limiting manner, and the ends of the positioning blocks are abutted against the bottoms of the positioning grooves in a limiting manner.

In the above transmission rod assembly, an outer circumferential wall of the guide ring is disposed to be oblique and an inner circumferential wall of the locking cover is disposed to be oblique. When the locking cover is mounted on the other end of the sleeve pipe, the oblique surface on the locking cover is abutted against the oblique surface on the guide ring.

In the above transmission rod assembly, a plurality of reinforcing ribs are disposed equidistantly on the inner circumference wall of the sleeve pipe along its circumferential direction. A plurality of first fitting grooves are disposed equidistantly on at least part of the outer circumferential wall of the second transmission head along its circumferential direction. A plurality of second fitting grooves are disposed equidistantly on at least part of the outer circumferential wall of the jacket along its circumferential direction and the plurality of second fitting grooves extend to the protruding ring. Ends of the plurality of reinforcing ribs protrude into the plurality of first fitting grooves respectively, and the other ends of the plurality of reinforcing ribs protrude into the plurality of second fitting grooves respectively.

In the above transmission rod assembly, an abutting sleeve is further disposed inside the sleeve pipe and sleeved on an end of the first transmission rod, and the other end of the elastic piece is abutted against the abutting sleeve.

Provided is a height-adjustable desk, comprising the transmission rod assembly according to any one of the above items and further comprising: at least two support transmission mechanisms, where the first transmission rod and the second transmission rod both are provided with a transmission gear respectively and the two support transmission mechanisms are in respective transmission connection with the transmission gears.

Compared with the existing technology, the above technical solution has the following positive effects.

In the present invention, an original screw structure is removed from between the two transmission heads, and an oblique transmission head structures are adopted. Thus, under the action of the elastic piece, automatic extension for increasing squeeze is achieved, leading to easy mounting.

In the present invention, two locking columns on the locking cover are respectively mounted into two locking grooves of the sleeve pipe, and their limiting cooperation can be achieved by mutual rotational locking, i.e. pressing and rotating, without requiring a user to carry out multiple fixing operations, leading to convenience and high dismounting and mounting efficiency.

BRIEF DESCRIPTIONS OF THE DRAWINGS

Numerals of the drawings are described below: 1. first transmission head, 2. second transmission head, 3. elastic piece, 4. positioning groove, 5. positioning block, 6. first oblique surface, 7. second oblique surface, 8. protruding column, 9. recess, 10. sleeve pipe, 11. first transmission rod, 12. second transmission rod, 13. locking cover, 14. jacket, 15. hexagonal insertion groove, 16. hexagonal penetration groove, 17. guide ring, 18. clearance, 19. first cylindrical support platform, 20. second cylindrical support platform, 21. transmission rod assembly, 22. support transmission mechanism, 23. transmission gear, 24. abutting sleeve, 25. locking groove, 26. locking column, 27. protruding ring, 28.

reinforcing rib, 29. first fitting groove, 30. second fitting groove, 31. axial guide groove, 32. circumferential limiting groove.

DETAILED DESCRIPTIONS OF EMBODIMENTS

The present invention will be further described in combination with the accompanying drawings and specific embodiments but these drawings and embodiments shall not be used as limitation to the present invention.

Figure 1:
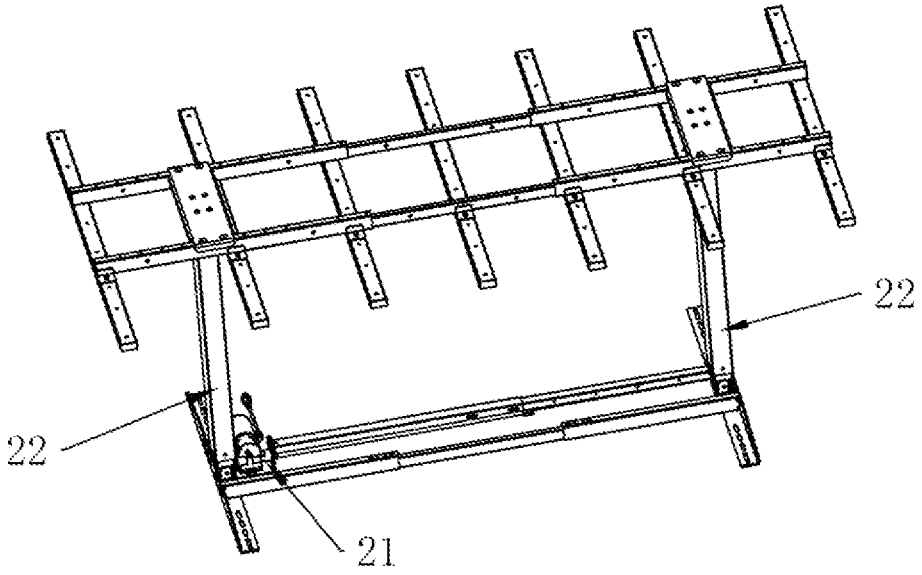
FIG. 1 is a schematic diagram illustrating an entire structure of a height-adjustable desk according to the present invention.
Figure 2:
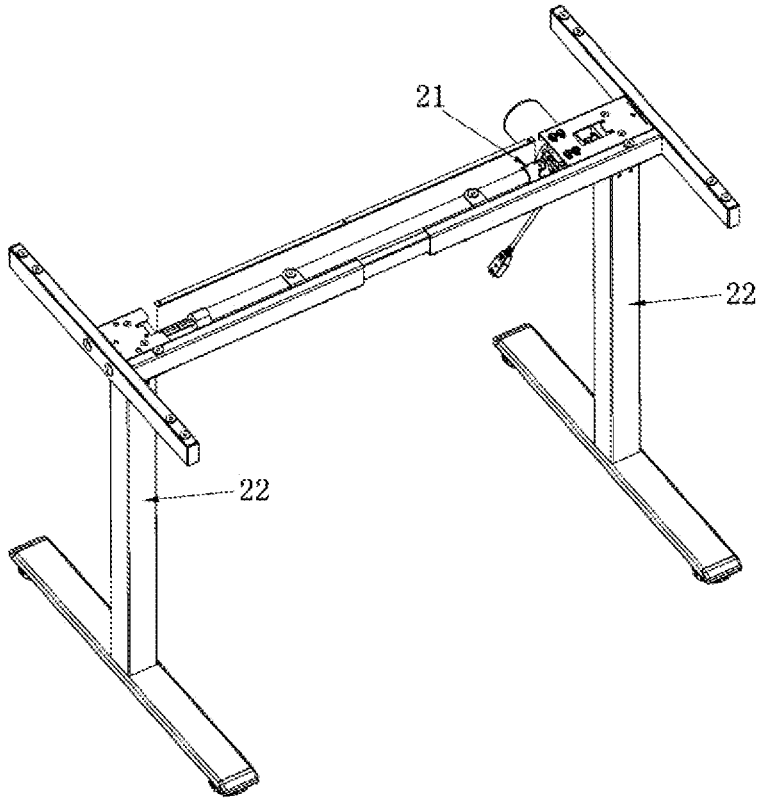
FIG. 2 is a structural schematic diagram illustrating a height-adjustable desk according to the present invention.
Figure 3:
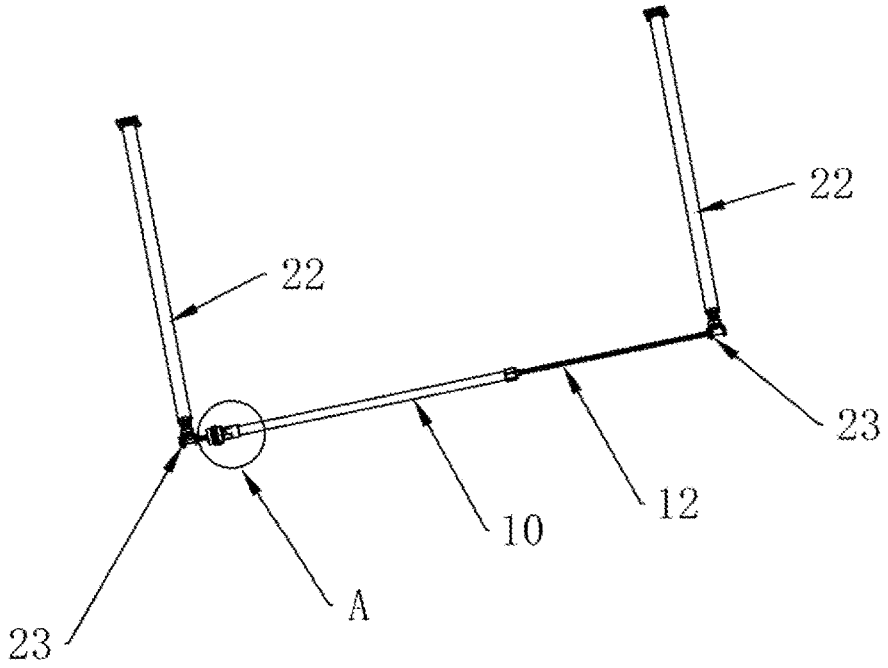
FIG. 3 is a partial structural schematic diagram illustrating a height-adjustable desk according to the present invention.
Figure 4:
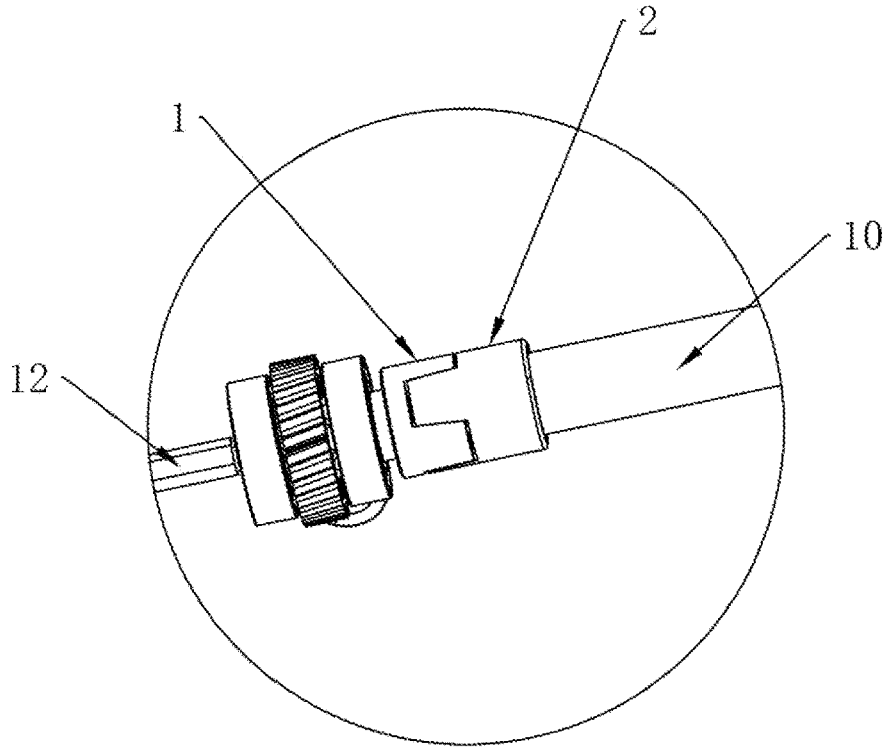
FIG. 4 is an enlarged view of a position A of the height-adjustable desk shown in FIG. 3 according to the present invention.
Figure 5:
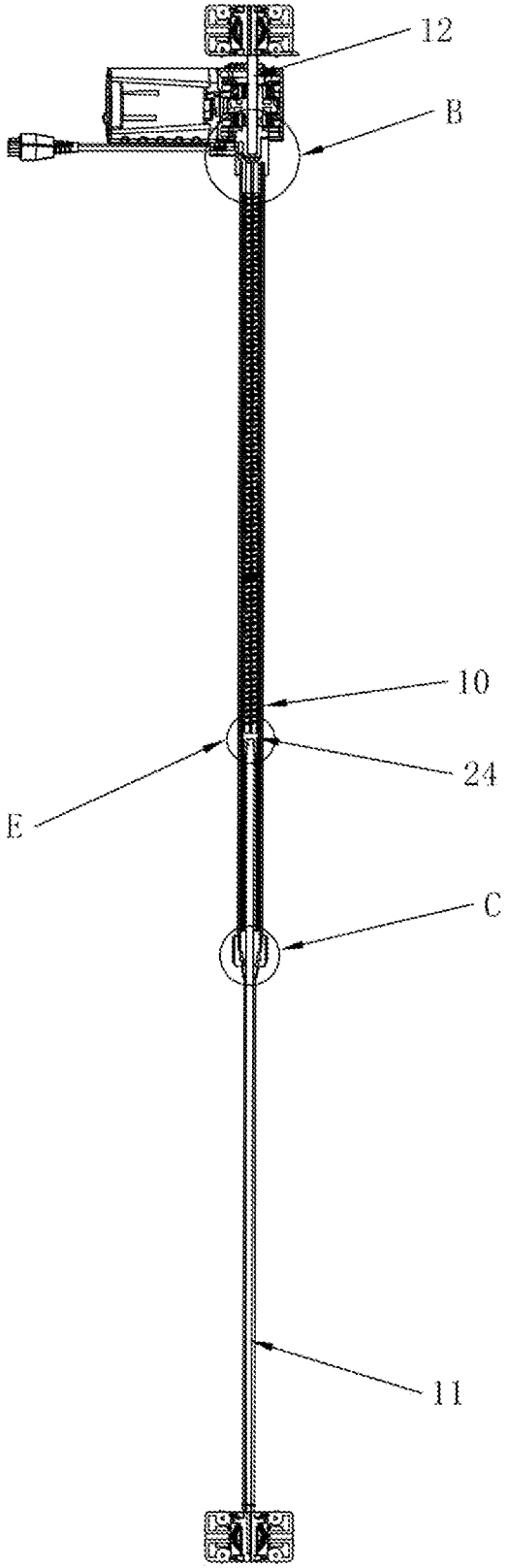
FIG. 5 is a schematic diagram illustrating an entire structure of a transmission rod assembly according to the present invention.
Figure 6:
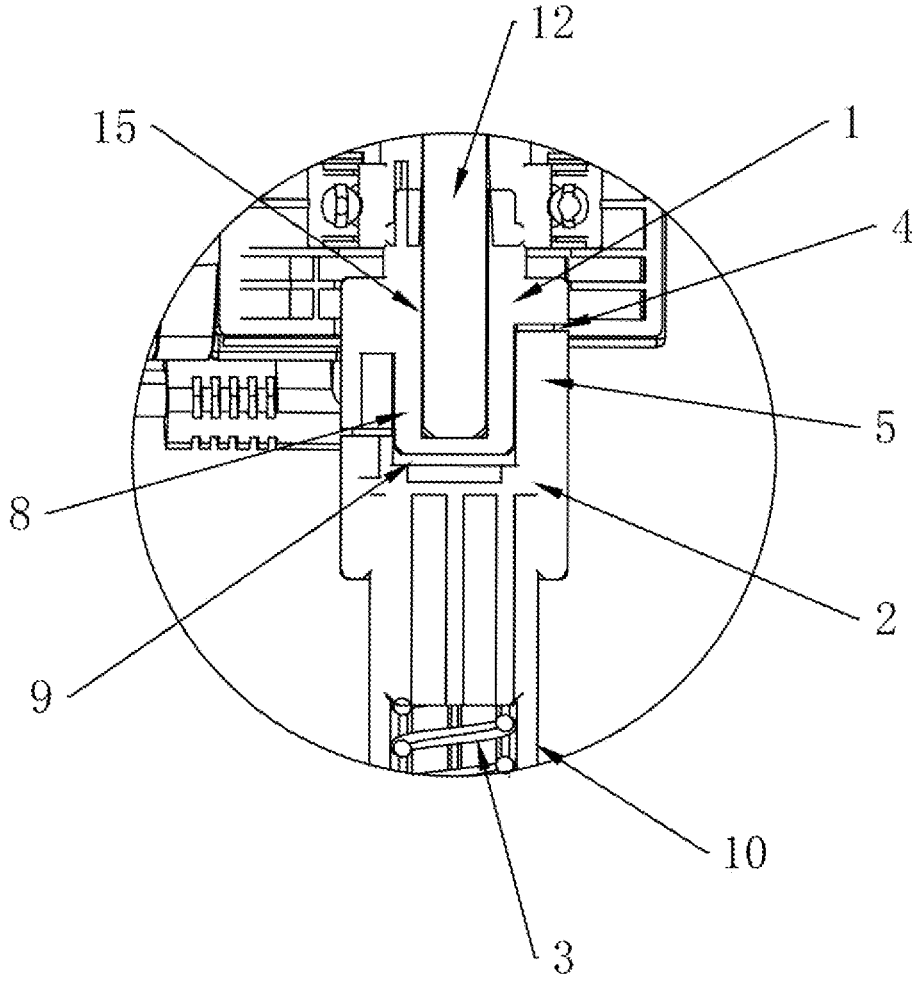
FIG. 6 is an enlarged view of a position B of the transmission rod assembly shown in FIG. 5 according to the present invention.
Figure 7:
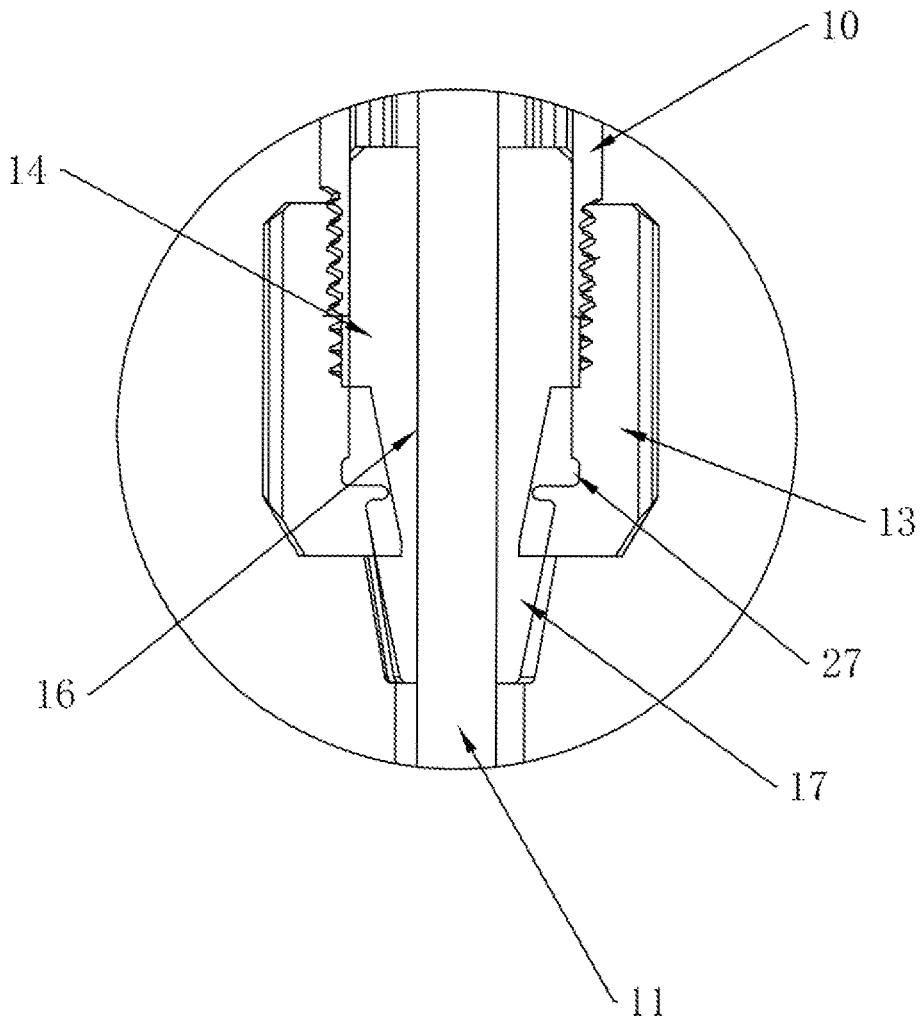
FIG. 7 is an enlarged view of a position C of the transmission rod assembly shown in FIG. 5 according to the present invention.
Figure 8:
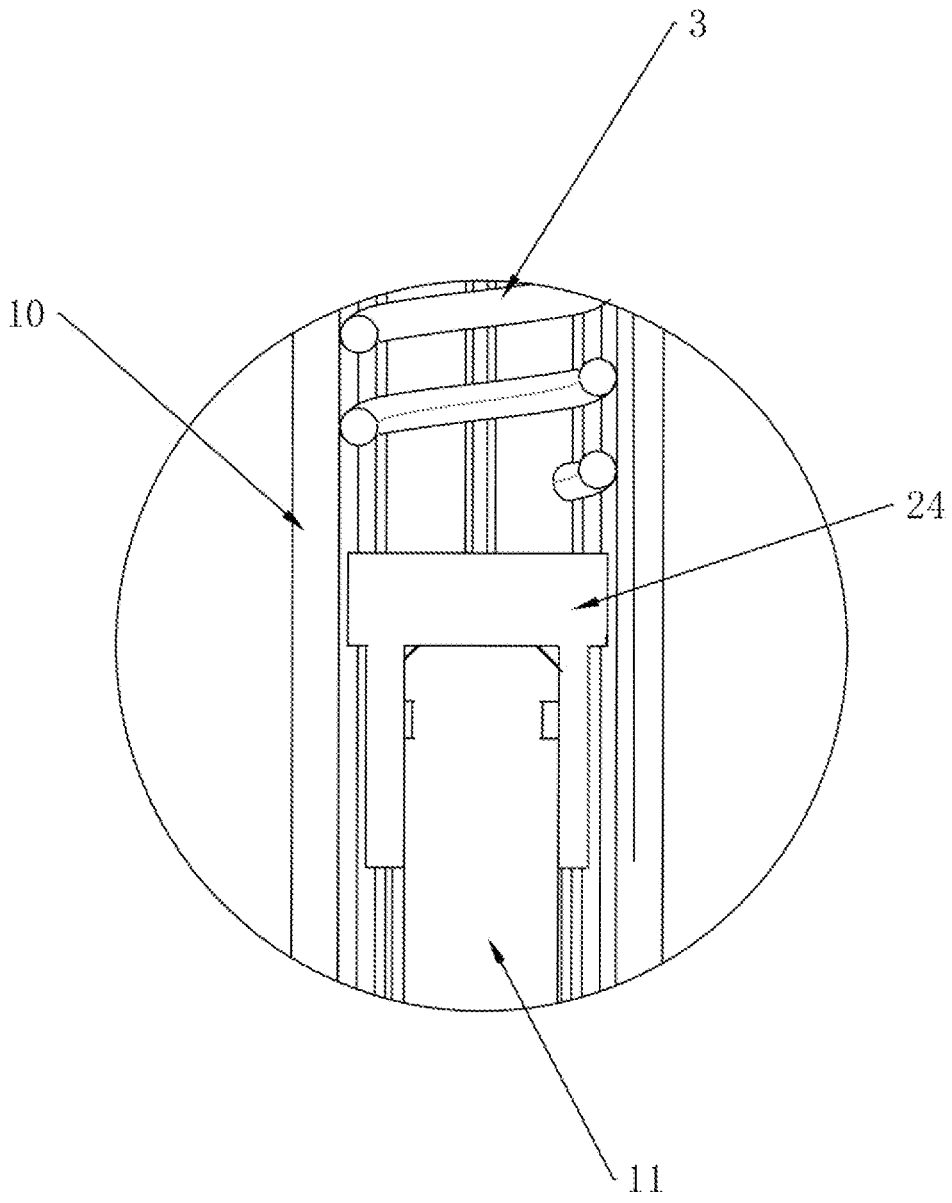
FIG. 8 is an enlarged view of a position E of the transmission rod assembly shown in FIG. 5 according to the present invention.
Figure 9:
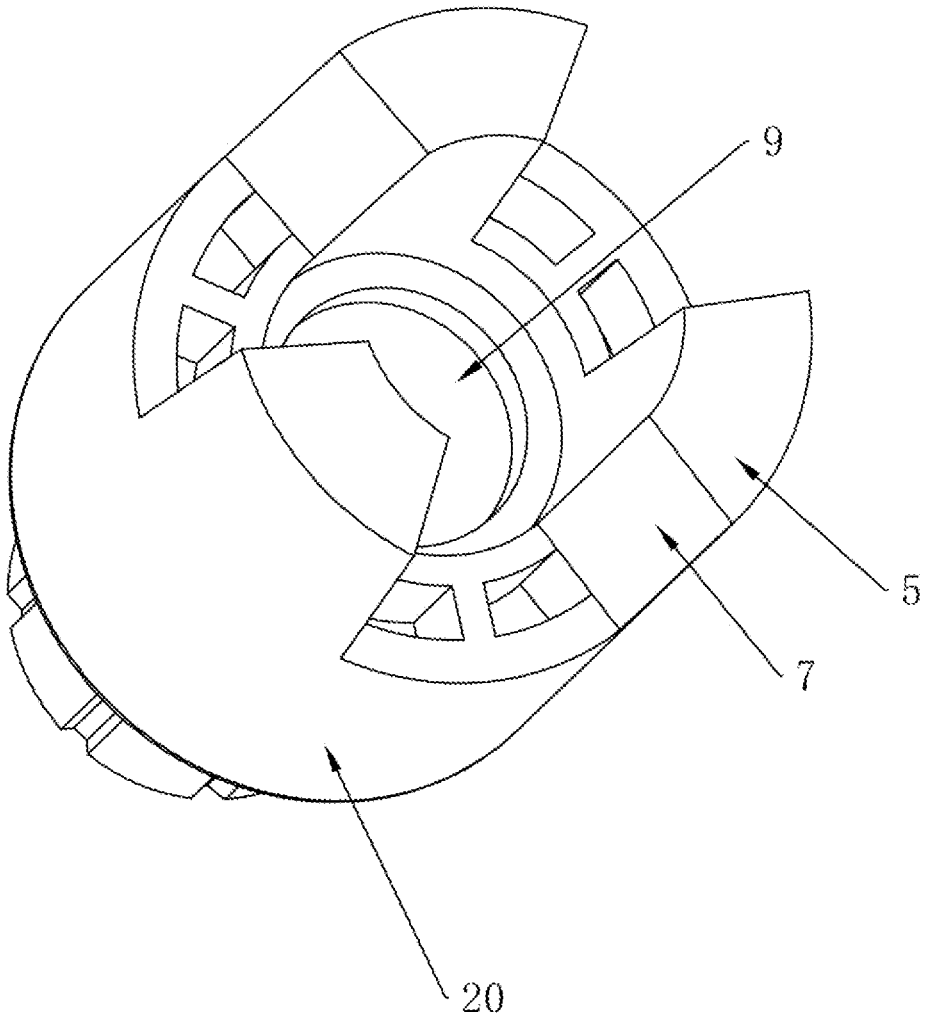
FIG. 9 is a structural schematic diagram illustrating a second transmission head of a transmission rod assembly according to the present invention.
Figure 10:
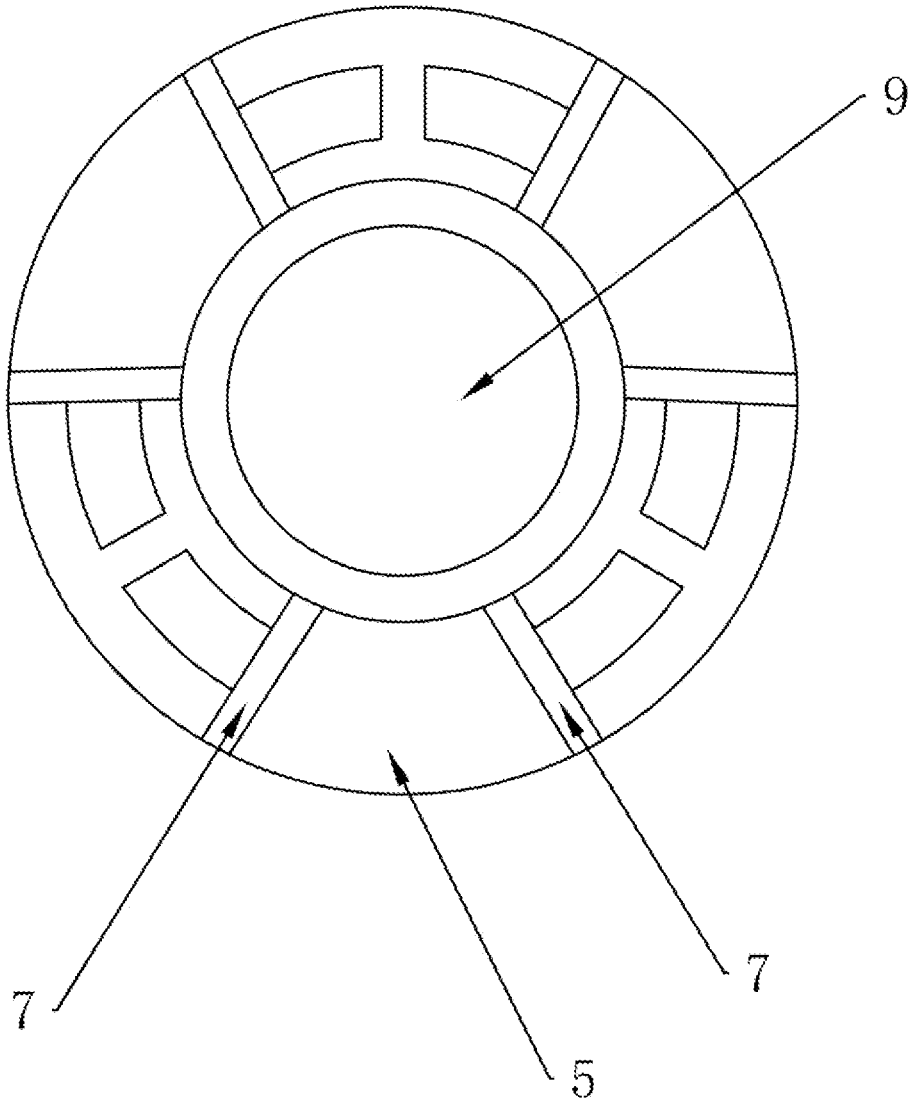
FIG. 10 is a structural schematic diagram illustrating a second transmission head of a transmission rod assembly according to the present invention.
Figure 11:
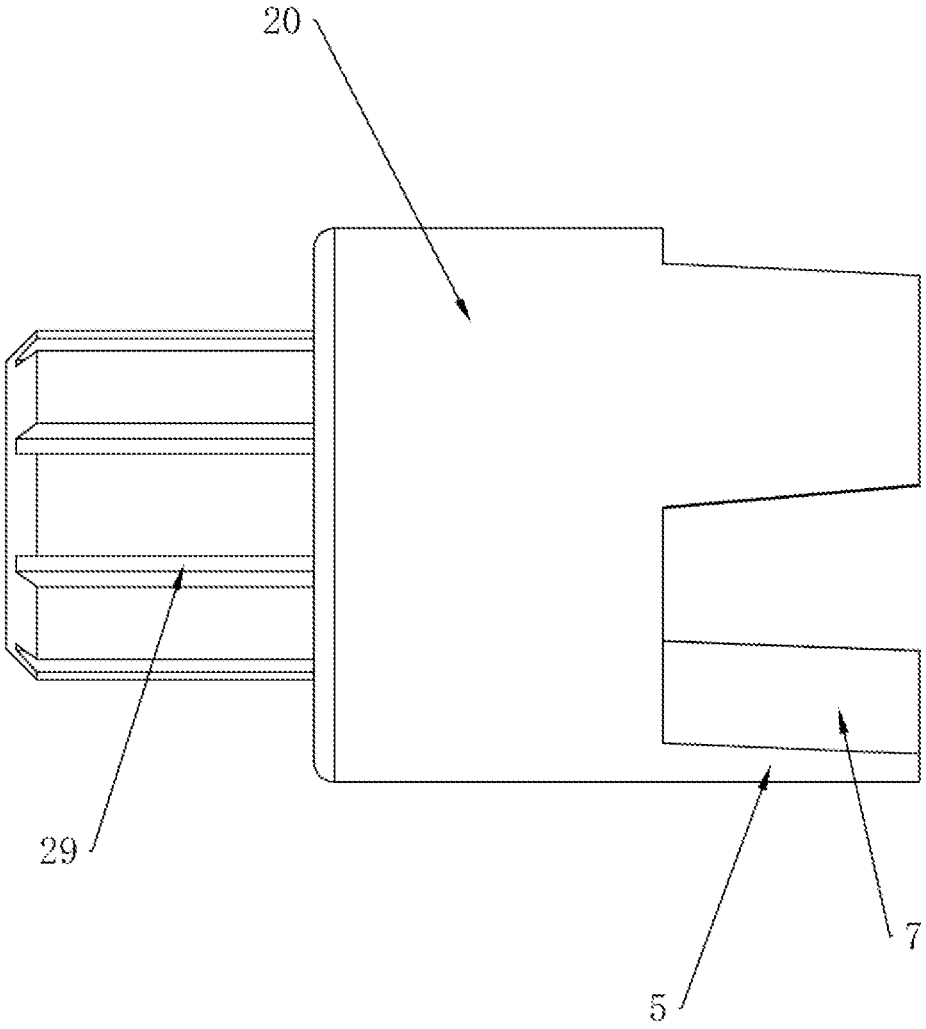
FIG. 11 is a structural schematic diagram illustrating a second transmission head of a transmission rod assembly according to the present invention.
Figure 12:
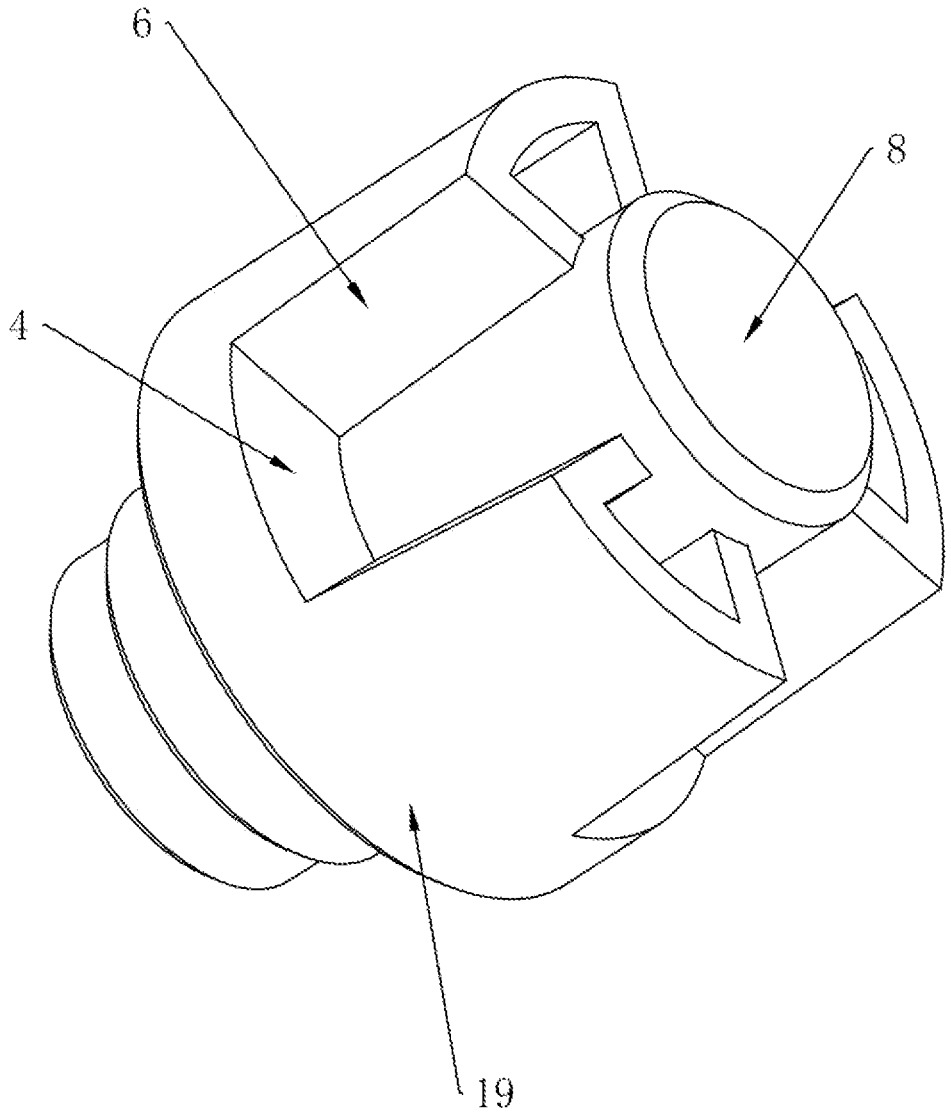
FIG. 12 is a structural schematic diagram illustrating a first transmission head of a transmission rod assembly according to the present invention.
Figure 13:
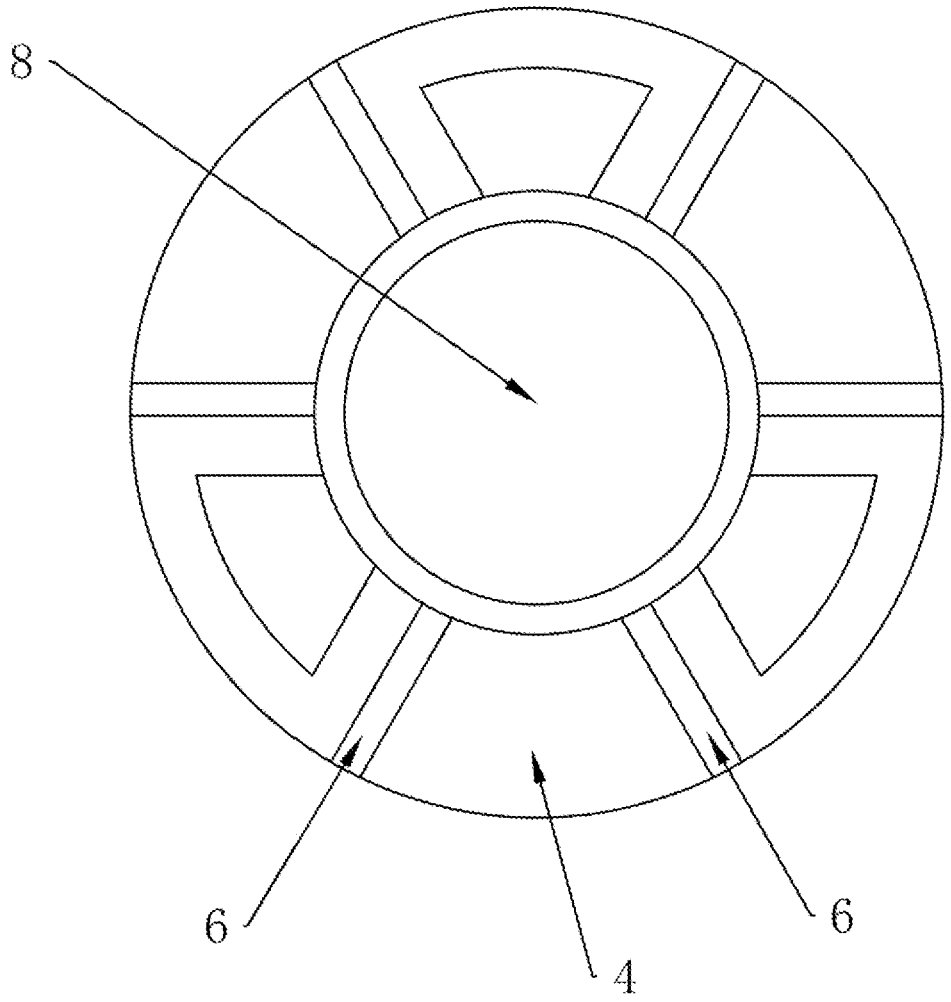
FIG. 13 is a structural schematic diagram illustrating a first transmission head of a transmission rod assembly according to the present invention.
Figure 14:
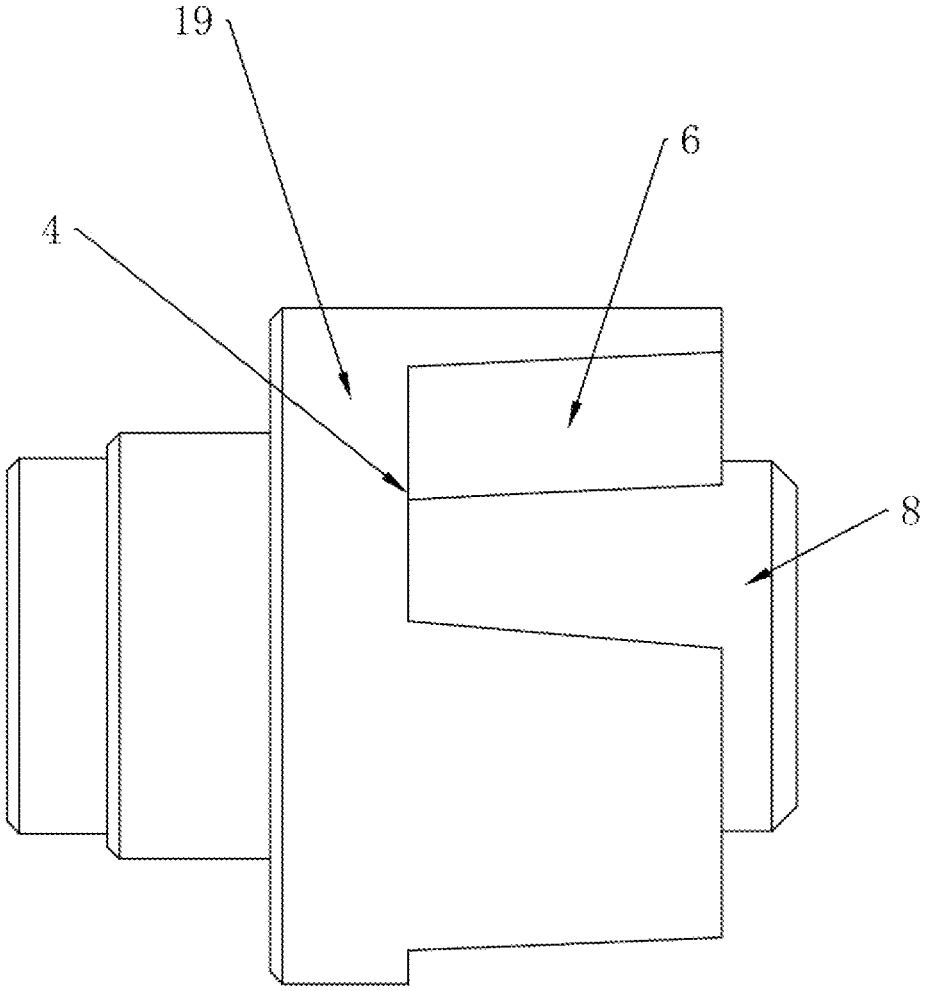
FIG. 14 is a structural schematic diagram illustrating a first transmission head of a transmission rod assembly according to the present invention.
Figure 15:
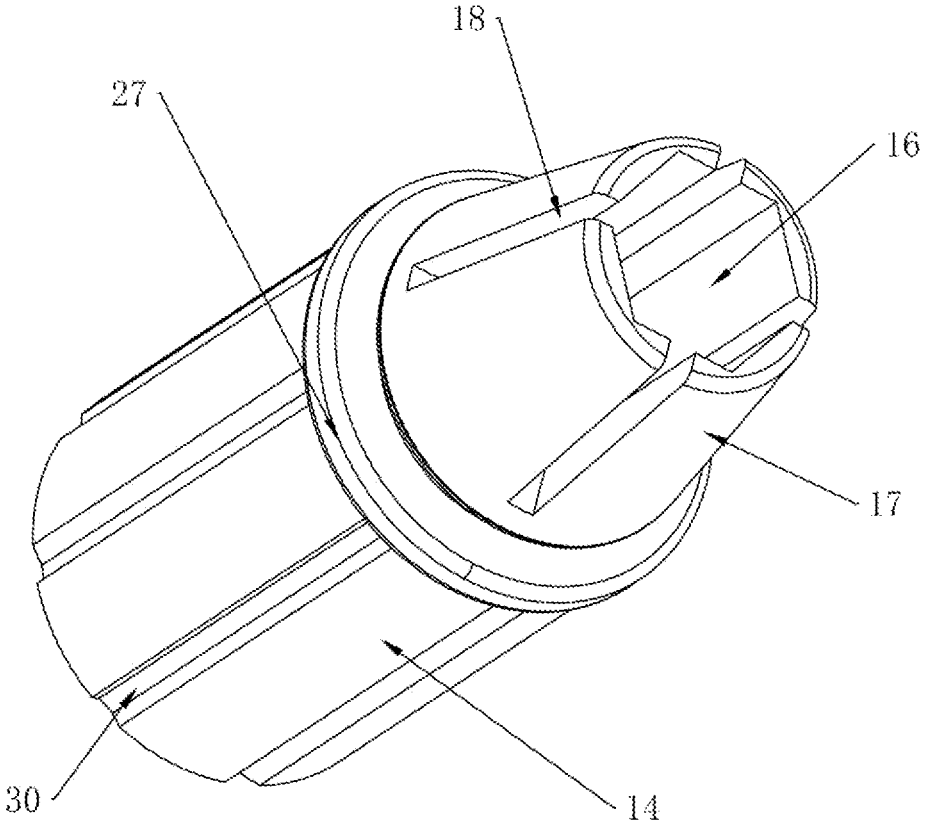
FIG. 15 is a structural schematic diagram illustrating a jacket of a transmission rod assembly according to the present invention.
Figure 16:
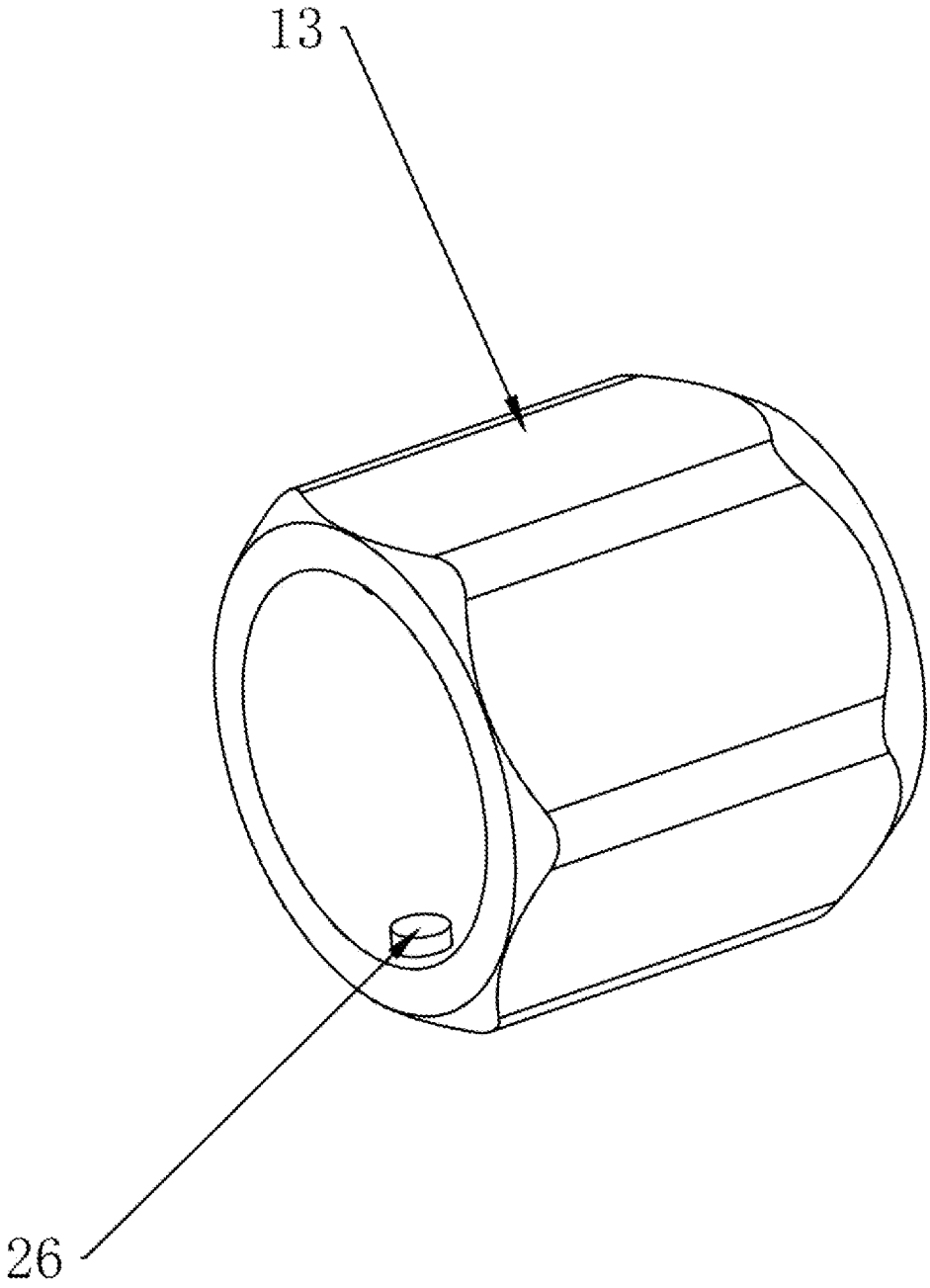
FIG. 16 is a structural schematic diagram illustrating a locking cover of a transmission rod assembly according to the present invention.
Figure 17:
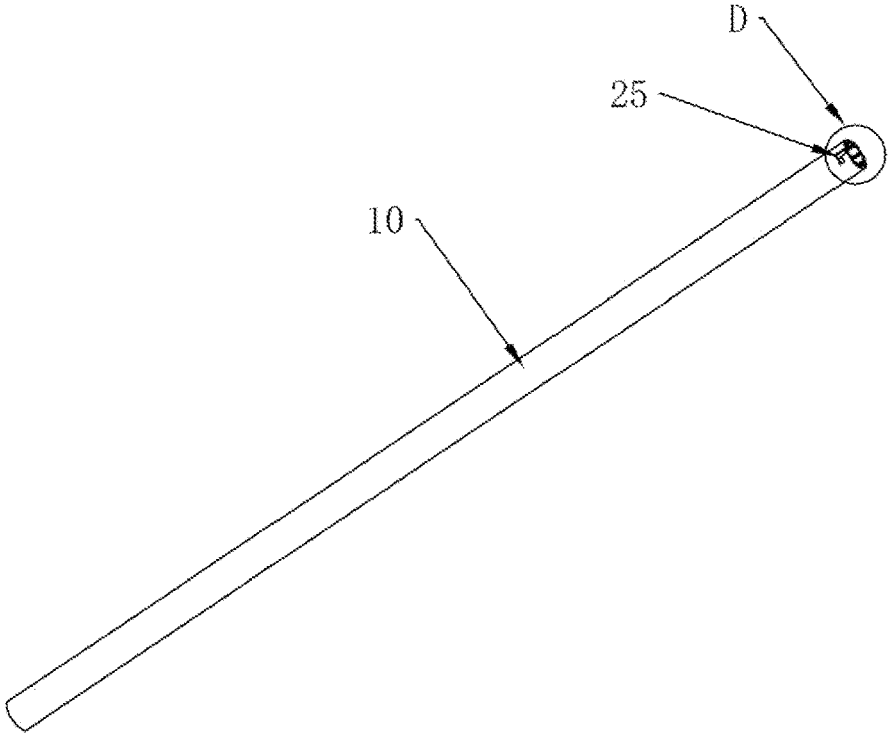
FIG. 17 is a structural schematic diagram illustrating a sleeve pipe of a transmission rod assembly according to the present invention.
Figure 18:
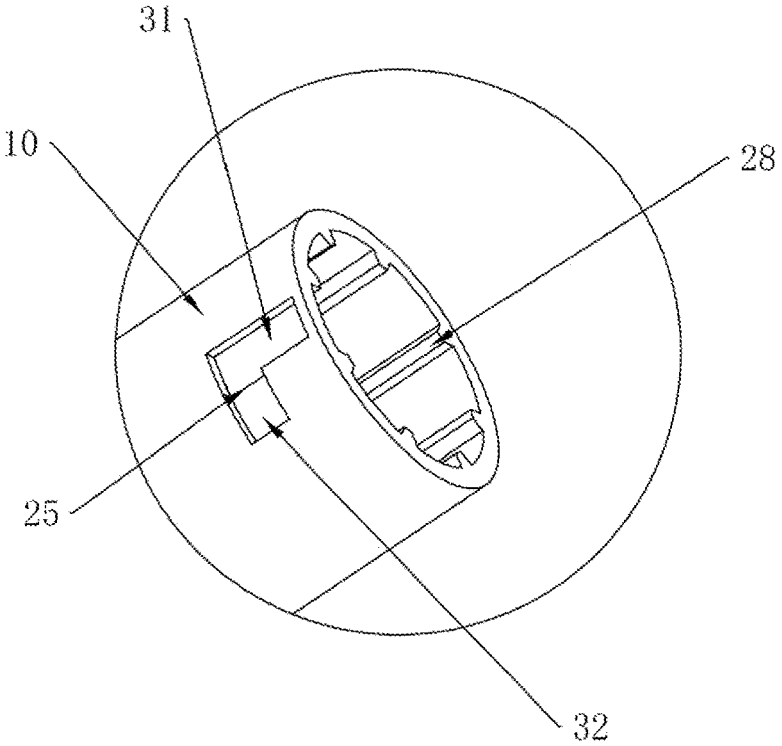
FIG. 18 is an enlarged view of a position D of the transmission rod assembly shown in FIG. 17 according to the present invention.

FIG. 1 is a schematic diagram illustrating an entire structure of a height-adjustable desk according to the present invention. FIG. 2 is a structural schematic diagram illustrating a height-adjustable desk according to the present invention. FIG. 3 is a partial structural schematic diagram illustrating a height-adjustable desk according to the present invention. FIG. 4 is an enlarged view of a position A of the height-adjustable desk shown in FIG. 3 according to the present invention. FIG. 5 is a schematic diagram illustrating an entire structure of a transmission rod assembly according to the present invention. FIG. 6 is an enlarged view of a position B of the transmission rod assembly shown in FIG. 5 according to the present invention. FIG. 7 is an enlarged view of a position C of the transmission rod assembly shown in FIG. 5 according to the present invention. FIG. 8 is an enlarged view of a position E of the transmission rod assembly shown in FIG. 5 according to the present invention. FIG. 9 is a structural schematic diagram illustrating a second transmission head of a transmission rod assembly according to the present invention. FIG. 10 is a structural schematic diagram illustrating a second transmission head of a transmission rod assembly according to the present invention. FIG. 11 is a structural schematic diagram illustrating a second transmission head of a transmission rod assembly according to the present invention. FIG. 12 is a structural schematic diagram illustrating a first transmission head of a transmission rod assembly according to the present invention. FIG. 13 is a structural schematic diagram illustrating a first transmission head of a transmission rod assembly according to the present invention. FIG. 14 is a structural schematic diagram illustrating a first transmission head of a transmission rod assembly according to the present invention. FIG. 15 is a structural schematic diagram illustrating a jacket of a transmission rod assembly according to the present invention. FIG. 16 is a structural schematic diagram illustrating a locking cover of a transmission rod assembly according to the present invention. FIG. 17 is a structural schematic diagram illustrating a sleeve pipe of a transmission rod assembly according to the present invention. FIG. 18 is an enlarged view of a position D of the transmission rod assembly shown in FIG. 17 according to the present invention. As shown in FIGS. 1 to 18, there is provided a transmission rod assembly according to a preferred embodiment, comprising: a first transmission head 1, a second transmission head 2 and an elastic piece 3. A plurality of positioning grooves 4 are disposed along a circumferential direction of the first transmission head 1. A plurality of positioning blocks 5 disposed along a circumferential direction of the second transmission head 2. The elastic piece 3 is abutted against the first transmission head 1 or the second transmission head 2. The second transmission head and the first transmission head are abutted against each other in an axial limiting manner by use of a restoring force of the elastic piece, and the plurality of positioning blocks 5 are cooperated with the plurality of positioning grooves 4 in a positioning manner respectively.

Preferably, the elastic piece 3 is abutted against the second transmission head 2.

Preferably, the elastic piece 3 is a spring.

Furthermore, as a preferred embodiment, the transmission rod assembly further comprises: a sleeve pipe 10, a first transmission rod 11 and a locking assembly. The sleeve pipe 10 is a hollow structure with both ends open. The second transmission head 2 is mounted at an end of the sleeve pipe 10, the elastic piece 3 is mounted in the sleeve pipe 10, and an end of the elastic piece 3 is abutted against the second transmission head 2. An end of the first transmission rod 11 protrudes into the other end of the sleeve pipe 10 and is abutted against the other end of the elastic piece 3. The sleeve pipe 10 is cooperated with the first transmission rod 11 in a limiting manner along a circumferential direction of the sleeve pipe 10, and the sleeve pipe 10 is cooperated with the first transmission rod 11 in a limiting manner along an axial direction of the sleeve pipe 10. The locking assembly is mounted on the other end of the sleeve pipe 10, the locking assembly is cooperated with the sleeve pipe 10 in a limiting manner along the axial direction of the sleeve pipe 10, and the locking assembly clamps the first transmission rod 11.

Furthermore, as a preferred embodiment, the positioning groove 4 has at least one first oblique surface 6, the positioning block 5 has at least one second oblique surface 7, and the first oblique surface 6 and the second oblique surface 7 are abutted against each other.

Furthermore, as a preferred embodiment, both sides of the positioning groove 4 have the first oblique surface 6, and both sides of the positioning block 5 have the second oblique surface 7. When the second transmission head 2 is abutted against the first transmission head 1 in an axial limiting manner, a plurality of positioning blocks 5 cooperate with a plurality of positioning grooves 4 in a positioning manner respectively and the first oblique surfaces 6 are abutted against the second oblique surfaces 7.

Furthermore, as a preferred embodiment, the first transmission head 1 has a protruding column 8, and a plurality of positioning grooves 4 are located around the protruding column 8; the second transmission head 2 has a recess 9, and a plurality of positioning blocks 5 are located around the recess 9. When the second transmission head 2 is abutted against the first transmission head 1 in an axial limiting manner, the protruding column 8 cooperates with the recess 9 in a positioning manner.

The above are only the preferred embodiments of the present invention and thus do not limit the embodiments and the scope of protection of the present invention.

Based on the above, the present invention further has the following embodiments.

In a further embodiment of the present invention, with continuous reference to FIGS. 1 to 18, the transmission rod assembly further comprises: a second transmission rod 12, where the second transmission rod 12 is in a transmission connection with the first transmission head 1.

In a further embodiment of the present invention, the first transmission rod 11 and the second transmission rod 12 both are hexagonal transmission rods and the first transmission head 1 has a hexagonal insertion groove 15.

In a further embodiment of the present invention, the locking assembly comprises a locking cover 13 and a jacket 14. The locking cover 13 is fixedly connected with the sleeve pipe 10, and the jacket 14 is sleeved on the first transmission rod 11. The locking cover 13 is operably abutted against an outer wall of the jacket 14. At least part of the jacket 14 deforms to reduce an inner diameter of at least part of the jacket 14 so as to clamp the first transmission rod 11.

Preferably, the locking cover 13 is thread-connected with the sleeve pipe 10.

In a further embodiment of the present invention, a hexagonal penetration groove 16 is disposed inside the jacket 14, the second transmission rod 12 is cooperated with the hexagonal insertion groove 15 in an insertion manner, the first transmission rod 11 penetrates through the hexagonal penetration groove 16, and the jacket 14 is fixedly cooperated with the first transmission rod 11 by use of squeeze and shrinkage of the locking cover 13.

In a further embodiment of the present invention, a guide ring 17 is disposed at an end of the jacket 14, and a plurality of clearances 18 are disposed on the guide ring 17. The locking cover 13 squeezes the guide ring 17 to enable the guide ring 17 to shrink and clamp the first transmission rod 11.

In a further embodiment of the present invention, two locking grooves 25 are disposed on a sidewall of the other end of the sleeve pipe 10, and two locking columns 26 are disposed on an inner wall of the locking cover 13. The two locking columns 26 are cooperated with the two locking grooves 25 in a limiting manner respectively.

In a further embodiment of the present invention, when the locking cover 13 is sleeved on the other end of the sleeve pipe 10, the two locking columns 26 protrude into the two locking grooves 25 respectively. By rotating the sleeve pipe 10 or the locking cover 13, the two locking columns 26 are cooperated with the two locking grooves 25 in a limiting manner along the axial direction of the sleeve pipe 10 respectively.

In a further embodiment of the present invention, a protruding ring 27 is disposed along a periphery of the jacket 14. The other end of the sleeve pipe 10 is sleeved on a part of the jacket 14, and the end portion of the other end of the sleeve pipe 10 is abutted against the protruding ring 27.

In a further embodiment of the present invention, the first transmission head 1 has a first cylindrical support platform 19, the protruding column 8 is disposed in a middle portion of the first cylindrical support platform 19, and a plurality of positioning grooves 4 are located on the periphery of the first cylindrical support platform 19; the second transmission head 2 has a second cylindrical support platform 20, the recess 9 is disposed in a middle portion of the second cylindrical support platform 20, and a plurality of positioning blocks 5 are disposed on the periphery of the second cylindrical support platform 20 respectively. The first cylindrical support platform 19 has the same diameter as the second cylindrical support platform 20.

In a further embodiment of the present invention, when the second transmission head 2 is abutted against the first transmission head 1 in an axial limiting manner, a plurality of positioning blocks 5 are inserted into a plurality of positioning grooves 4 respectively, and the protruding column 8 is inserted into the recess 9. In this case, an end of the protruding column 8 is abutted against the bottom of the recess 9 in a limiting manner, the first oblique surfaces 6 are abutted against the second oblique surfaces 7 in a limiting manner, and the ends of the positioning blocks 5 are abutted against the bottoms of the positioning grooves 6 in a limiting manner.

In a further embodiment of the present invention, an outer circumferential wall of the guide ring 17 is disposed to be oblique and an inner circumferential wall of the locking cover 13 is disposed to be oblique. When the locking cover 13 is mounted on the other end of the sleeve pipe 10, the oblique surface on the locking cover 13 is abutted against the oblique surface on the guide ring 17.

In a further embodiment of the present invention, a plurality of reinforcing ribs 28 are disposed equidistantly on the inner circumference wall of the sleeve pipe 10 along its circumferential direction. A plurality of first fitting grooves 29 are disposed equidistantly on at least part of the outer circumferential wall of the second transmission head 2 along its circumferential direction. A plurality of second fitting grooves 30 are disposed equidistantly on at least part of the outer circumferential wall of the jacket 14 along its circumferential direction and the plurality of second fitting grooves 30 extend to the protruding ring 27. Ends of the plurality of reinforcing ribs 28 protrude into the plurality of first fitting grooves 29 respectively, and the other ends of the plurality of reinforcing ribs 28 protrude into the plurality of second fitting grooves 30 respectively.

In a further embodiment of the present invention, an abutting sleeve 24 is further disposed inside the sleeve pipe 10 and sleeved on an end of the first transmission rod 11, and the other end of the elastic piece 3 is abutted against the abutting sleeve 24.

The present invention further provides a height-adjustable desk, comprising the above transmission rod assembly 21 and further comprising: at least two support transmission mechanisms 22, where the first transmission rod 11 and the second transmission rod 12 both are provided with a transmission gear 23 respectively and the two support transmission mechanisms 22 are in respective transmission connection with the transmission gears 23.

In the present invention, two locking columns 26 on the locking cover 13 are respectively mounted into two locking grooves 25 of the sleeve pipe 10, and their limiting cooperation can be achieved by mutual rotational locking, i.e. pressing and rotating, without requiring a user to carry out multiple fixing operations, leading to convenience and high dismounting and mounting efficiency.

Preferably, the two locking grooves 25 both are L-shaped and the two locking columns 26 both are cylindrical.

Preferably, each locking groove 25 comprises an axial guide groove 31 and a circumferential limiting groove 32. The axial guide groove 31 is disposed on an outer wall of the sleeve pipe 10 along the axial direction of the sleeve pipe 10, and the circumferential limiting groove 32 is disposed on an outer wall of the sleeve pipe 10 along a circumferential direction of the sleeve pipe 10. The axial guide groove 31 is perpendicular to the circumferential limiting groove 32 to form an L-shaped groove. A communication part between the axial guide groove 31 and the circumferential limiting groove 32 is located at an end of the axial guide groove 31 close to the second transmission head 2.

Preferably, the locking cover is mounted from the end of the axial guide groove 31 away from the second transmission head 2 and the locking column 26 is mounted into the axial guide groove 31 at this time, and the locking cover 13 is pressed until the locking column 26 reaches the end of the axial guide groove 31 close to the second transmission head 2 and then the sleeve pipe 10 and the locking cover 13 are mutually rotated. At this time, the locking column 26 enters the circumferential limiting groove 32. After release, the locking column 26 is cooperated with the circumferential limiting groove 32 in a limiting manner along the axial direction of the sleeve pipe 10, that is, their cooperation can be achieved simply by pressing and rotating manually, leading to easy operations.

Preferably, the locking column 26 has a diameter equal to a width of the circumferential limiting groove 32.

In the present invention, an original screw structure is removed from between the two transmission heads, and an oblique transmission head structures are adopted. Thus, under the action of the elastic piece, automatic extension for increasing squeeze is achieved, leading to easy mounting.

In the present invention, two locking columns on the locking cover are respectively mounted into two locking grooves of the sleeve pipe, and their limiting cooperation can be achieved by mutual rotational locking, i.e. pressing and rotating, without requiring a user to carry out multiple fixing operations, leading to convenience and high dismounting and mounting efficiency.

The above are merely the preferred embodiments of the present invention and thus do not limit the embodiments and the scope of protection of the present invention. Those skilled in the art shall understand that all equivalent substitutions and obvious changes made using the specification and the illustrated contents of present invention shall fall within the scope of protection of the present invention.

The invention claimed is:

1. A transmission rod assembly, wherein it comprises:

a first transmission head, and a plurality of positioning grooves are disposed along a circumferential direction of the first transmission head;

a second transmission head, and a plurality of positioning blocks disposed along a circumferential direction of the second transmission head;

an elastic piece, abutted against the first transmission head or the second transmission head, and the second transmission head and the first transmission head are abutted against each other by use of a restoring force of the elastic piece; the plurality of positioning blocks are cooperated with the plurality of positioning grooves in a positioning manner respectively;

a sleeve pipe, and the sleeve pipe is a hollow structure with both ends open; the second transmission head is mounted at an end of the sleeve pipe, the elastic piece is mounted in the sleeve pipe, and an end of the elastic piece is abutted against the second transmission head;

a first transmission rod, and an end of the first transmission rod protrudes into the other end of the sleeve pipe and is abutted against the other end of the elastic piece, and the sleeve pipe and the first transmission rod are relatively fixed along a circumference of the sleeve pipe; and a locking assembly, and the locking assembly is mounted on the other end of the sleeve pipe, the locking assembly is cooperated with the sleeve pipe in a limiting manner along the axial direction of the sleeve pipe, and the locking assembly clamps the first transmission rod.

2. The transmission rod assembly of claim 1, wherein both sides of the positioning groove have a first oblique surface, and both sides of the positioning block have a second oblique surface, the first and second oblique surfaces being oblique with respect to an axis of the sleeve pipe; a plurality of positioning blocks cooperate with a plurality of positioning grooves in a positioning manner respectively and the first oblique surfaces are abutted against the second oblique surfaces when the second transmission head is abutted against the first transmission head.

3. A height-adjustable desk, wherein the height-adjustable desk comprises the transmission rod assembly of claim 2, and it further comprises at least two support transmission mechanisms, and the first transmission rod and the second transmission rod both are provided with a transmission gear respectively and the two support transmission mechanisms are in respective transmission connection with the transmission gears.

4. The transmission rod assembly of claim 2, wherein the first transmission head has a protruding column, and a plurality of positioning grooves are located around the protruding column; the second transmission head has a recess, and a plurality of positioning blocks are located around the recess; the protruding column cooperates with the recess in a positioning manner when the second transmission head is abutted against the first transmission head.

5. A height-adjustable desk, wherein the height-adjustable desk comprises the transmission rod assembly of claim 4, and it further comprises at least two support transmission mechanisms, and the first transmission rod and the second transmission rod both are provided with a transmission gear respectively and the two support transmission mechanisms are in respective transmission connection with the transmission gears.

6. The transmission rod assembly of claim 4, wherein it further comprises a second transmission rod, and the second transmission rod is in transmission connection with the first transmission head; the first transmission rod and the second transmission rod both are hexagonal transmission rods and the first transmission head has a hexagonal insertion groove.

7. A height-adjustable desk, wherein the height-adjustable desk comprises the transmission rod assembly of claim 6, and it further comprises at least two support transmission mechanisms, and the first transmission rod and the second transmission rod both are provided with a transmission gear respectively and the two support transmission mechanisms are in respective transmission connection with the transmission gears.

8. The transmission rod assembly of claim 6, wherein the locking assembly comprises a locking cover and a jacket; the locking cover is fixedly connected with the sleeve pipe, and the jacket is sleeved on the first transmission rod; the locking cover is operably abutted against an outer wall of the jacket; at least part of the jacket deforms to reduce an inner diameter of at least part of the jacket so as to clamp the first transmission rod; a hexagonal penetration groove is disposed inside the jacket, the second transmission rod is inserted into the hexagonal insertion groove in an insertion manner, the first transmission rod penetrates through the hexagonal penetration groove, and the jacket is fixedly cooperated with the first transmission rod by use of squeeze and shrinkage of the locking cover; a guide ring is disposed at an end of the jacket, and a plurality of clearances are disposed on the guide ring; the locking cover squeezes the guide ring to enable the guide ring to shrink and clamp the first transmission rod; two locking grooves are disposed on a sidewall of the other end of the sleeve pipe, and two locking columns are disposed on an inner wall of the locking cover when the locking cover is sleeved on the other end of the sleeve pipe, the two locking columns protrude into the two locking grooves respectively; by rotating the sleeve pipe or the locking cover, the two locking columns are snap into the two locking grooves in a limiting manner along the axial direction of the sleeve pipe respectively; a protruding ring is disposed along a periphery of the jacket; the other end of the sleeve pipe is sleeved on a part of the jacket, and the end portion of the other end of the sleeve pipe is abutted against the protruding ring.

9. A height-adjustable desk, wherein the height-adjustable desk comprises the transmission rod assembly of claim 8, and it further comprises at least two support transmission mechanisms, and the first transmission rod and the second transmission rod both are provided with a transmission gear respectively and the two support transmission mechanisms are in respective transmission connection with the transmission gears.

10. The transmission rod assembly of claim 8, wherein the first transmission head has a first cylindrical support platform, the protruding column is disposed in a middle portion of the first cylindrical support platform, and a plurality of positioning grooves are located on the periphery of the first cylindrical support platform; the second transmission head has a second cylindrical support platform, the recess is disposed in a middle portion of the second cylindrical support platform, and a plurality of positioning blocks are disposed on the periphery of the second cylindrical support platform respectively; the first cylindrical support platform has the same diameter as the second cylindrical support platform; when the second transmission head is abutted against the first transmission head, a plurality of positioning blocks are inserted into a plurality of positioning grooves respectively, and the protruding column is inserted into the recess and an end of the protruding column is abutted against the bottom of the recess a limiting manner, the first oblique surfaces are abutted against the second oblique surfaces in, and the ends of the positioning blocks are abutted against the bottoms of the positioning grooves.

11. A height-adjustable desk, wherein the height-adjustable desk comprises the transmission rod assembly of claim 10, and it further comprises at least two support transmission mechanisms, and the first transmission rod and the second transmission rod both are provided with a transmission gear respectively and the two support transmission mechanisms are in respective transmission connection with the transmission gears.

12. The transmission rod assembly of claim 10, wherein an outer circumferential wall of the guide ring is disposed to be oblique and an inner circumferential wall of the locking cover is disposed to be oblique; when the locking cover is mounted on the other end of the sleeve pipe, the oblique surface on the locking cover is abutted against the oblique surface on the guide ring.

13. A height-adjustable desk, wherein the height-adjustable desk comprises the transmission rod assembly of claim 12, and it further comprises at least two support transmission mechanisms, and the first transmission rod and the second transmission rod both are provided with a transmission gear respectively and the two support transmission mechanisms are in respective transmission connection with the transmission gears.

14. The transmission rod assembly of claim 12, wherein a plurality of reinforcing ribs are disposed equidistantly on the inner circumference wall of the sleeve pipe along its circumferential direction; a plurality of first fitting grooves are disposed equidistantly on at least part of the outer circumferential wall of the second transmission head along its circumferential direction; a plurality of second fitting grooves are disposed equidistantly on at least part of the outer circumferential wall of the jacket along its circumferential direction and the plurality of second fitting grooves extend to the protruding ring; ends of the plurality of reinforcing ribs protrude into the plurality of first fitting grooves respectively, and the other ends of the plurality of reinforcing ribs protrude into the plurality of second fitting grooves respectively.

15. A height-adjustable desk, wherein the height-adjustable desk comprises the transmission rod assembly of claim 14, and it further comprises at least two support transmission mechanisms, and the first transmission rod and the second transmission rod both are provided with a transmission gear respectively and the two support transmission mechanisms are in respective transmission connection with the transmission gears.

16. The transmission rod assembly of claim 14, wherein an abutting sleeve is further disposed inside the sleeve pipe and sleeved on an end of the first transmission rod, and the other end of the elastic piece is abutted against the abutting sleeve.

17. A height-adjustable desk, wherein the height-adjustable desk comprises the transmission rod assembly of claim 16, and it further comprises at least two support transmission mechanisms, and the first transmission rod and the second transmission rod both are provided with a transmission gear respectively and the two support transmission mechanisms are in respective transmission connection with the transmission gears.

* * * * *